US008526645B2

(12) United States Patent
Boillot et al.

(10) Patent No.: US 8,526,645 B2
(45) **Date of Patent: *Sep. 3, 2013**

(54) METHOD AND DEVICE FOR IN EAR CANAL ECHO SUPPRESSION

(75) Inventors: Marc Boillot, Plantation, FL (US); John Usher, Montreal (CA); Jason McIntosh, Surgar Hill, GA (US); Steven Goldstein, Delray Beach, FL (US)

(73) Assignee: Personics Holdings Inc., Boca Raton, FL (US)

( * ) Notice: Subject to any disclaimer, the term of this patent is extended or adjusted under 35 U.S.C. 154(b) by 1178 days.

This patent is subject to a terminal disclaimer.

(21) Appl. No.: 12/170,171

(22) Filed: Jul. 9, 2008

(65) Prior Publication Data

US 2009/0034765 A1 Feb. 5, 2009

Related U.S. Application Data

(63) Continuation-in-part of application No. 12/115,349, filed on May 5, 2008, now Pat. No. 8,081,780.

(60) Provisional application No. 60/916,271, filed on May 4, 2007.

(51) Int. Cl.
*H04R 5/02* (2006.01)

(52) U.S. Cl.
USPC ..... 381/309; 381/119

(58) Field of Classification Search
USPC ..... 381/74, 57, 94.1–94.5, 107, 309, 381/315, 59, 71.1, 380, 56, 71.11, 71.12; 379/207.02, 406.01–406.16; 704/260
See application file for complete search history.

(56) References Cited

U.S. PATENT DOCUMENTS

| | | | | |
|---|---|---|---|---|
| 5,131,032 | A | 7/1992 | Esaki et al. | |
| 5,692,059 | A | 11/1997 | Kruger | |
| 5,796,819 | A | 8/1998 | Romesburg | |
| 5,963,901 | A | 10/1999 | Vahatalo et al. | |
| 6,021,207 | A | 2/2000 | Puthuff et al. | |
| 6,081,732 | A | 6/2000 | Suvanen et al. | |
| 6,118,878 | A | 9/2000 | Jones | |
| 6,169,912 | B1 | 1/2001 | Zuckerman | |
| 6,466,666 | B1 | 10/2002 | Eriksson | |
| 6,570,985 | B1 * | 5/2003 | Romesburg | 379/406.08 |
| 6,631,196 | B1 | 10/2003 | Taenzer et al. | |
| 6,728,385 | B2 * | 4/2004 | Kvaløy et al. | 381/328 |
| 6,738,482 | B1 * | 5/2004 | Jaber | 381/94.7 |

(Continued)

OTHER PUBLICATIONS

Office Action for U.S. Appl. No. 12/135,816, filed Jun. 9, 2008, dated Oct. 20, 2011.

(Continued)

*Primary Examiner* — Lun-See Lao
(74) *Attorney, Agent, or Firm* — RatnerPrestia

(57) ABSTRACT

An earpiece (100) and acoustic management module (300) for in-ear canal echo suppression control suitable is provided. The earpiece can include an Ambient Sound Microphone (111) to capture ambient sound, an Ear Canal Receiver (125) to deliver audio content to an ear canal, an Ear Canal Microphone (123) configured to capture internal sound, and a processor (121) to generate a voice activity level (622) and suppress an echo of spoken voice in the electronic internal signal, and mix an electronic ambient signal with an electronic internal signal in a ratio dependent on the voice activity level and a background noise level to produce a mixed signal (323) that is delivered to the ear canal (131).

24 Claims, 5 Drawing Sheets

(56) References Cited

U.S. PATENT DOCUMENTS

| | | | | |
|---|---|---|---|---|
| 6,760,453 | B1 | 7/2004 | Banno | |
| 7,003,097 | B2 | 2/2006 | Marchok et al. | |
| 7,349,353 | B2 | 3/2008 | Guduru et al. | |
| 7,403,608 | B2 | 7/2008 | Auvray et al. | |
| 7,817,803 | B2 | 10/2010 | Goldstein | |
| 8,027,481 | B2 | 9/2011 | Beard | |
| 2004/0202340 | A1 | 10/2004 | Armstrong et al. | |
| 2005/0058313 | A1 | 3/2005 | Victorian et al. | |
| 2005/0069161 | A1 * | 3/2005 | Kaltenbach et al. | 381/312 |
| 2006/0067512 | A1 | 3/2006 | Boillot et al. | |
| 2007/0036342 | A1 | 2/2007 | Boillot et al. | |
| 2007/0189544 | A1 | 8/2007 | Rosenberg | |
| 2009/0034748 | A1 | 2/2009 | Sibbald | |

OTHER PUBLICATIONS

Office Action for U.S. Appl. No. 12/245,316, filed Oct. 3, 2008, dated Oct. 28, 2011.

Office Action for U.S. Appl. No. 12/245,316, filed Oct. 3, 2008, mailed Jun. 20, 2012.

* cited by examiner

201

600

METHOD AND DEVICE FOR IN EAR CANAL ECHO SUPPRESSION

CROSS REFERENCE TO RELATED APPLICATIONS

This application is a Continuation in Part of application Ser. No. 12/115,349 filed on May 5, 2008, now U.S. Pat. No. 8,081,780 that application which claims the priority benefit of Provisional Application No. 60/916,271 filed on May 4, 2007, the entire disclosure of both of which are incorporated herein by reference. This application is also related to application Ser. No. 11/110,773 filed on Apr. 28, 2008 claiming priority benefit of Provisional Application No. 60/914,318, the entire disclosure of which is incorporated herein by reference.

FIELD

The present invention pertains to sound reproduction, sound recording, audio communications and hearing protection using earphone devices designed to provide variable acoustical isolation from ambient sounds while being able to audition both environmental and desired audio stimuli. Particularly, the present invention describes a method and device for suppressing echo in an ear-canal when capturing a user's voice when using an ambient sound microphone and an ear canal microphone.

BACKGROUND

People use headsets or earpieces primarily for voice communications and music listening enjoyment. A headset or earpiece generally includes a microphone and a speaker for allowing the user to speak and listen. An ambient sound microphone mounted on the earpiece can capture ambient sounds in the environment; sounds that can include the user's voice. An ear canal microphone mounted internally on the earpiece can capture voice resonant within the ear canal; sounds generated when the user is speaking.

An earpiece that provides sufficient occlusion can utilize both the ambient sound microphone and the ear canal microphone to enhance the user's voice. An ear canal receiver mounted internal to the ear canal can loopback sound captured at the ambient sound microphone or the ear canal microphone to allow the user to listen to captured sound. If the earpiece is however not properly sealed within the ear canal, the ambient sounds can leak through into the ear canal and create an echo feedback condition with the ear canal microphone and ear canal receiver. In such cases, the feedback loop can generate an annoying "howling" sound that degrades the quality of the voice communication and listening experience.

SUMMARY

Embodiments in accordance with the present invention provide a method and device for in-ear canal echo suppression.

In a first embodiment, a method for in-ear canal echo suppression control can include the steps of capturing an ambient acoustic signal from at least one Ambient Sound Microphone (ASM) to produce an electronic ambient signal, capturing in an ear canal an internal sound from at least one Ear Canal Microphone (ECM) to produce an electronic internal signal, measuring a background noise signal from the electronic ambient signal and the electronic internal signal, and capturing in the ear canal an internal sound from an Ear Canal Microphone (ECM) to produce an electronic internal signal. The electronic internal signal includes an echo of a spoken voice generated by a wearer of the earpiece. The echo in the electronic internal signal can be suppressed to produce a modified electronic internal signal containing primarily the spoken voice. A voice activity level can be generated for the spoken voice based on characteristics of the modified electronic internal signal and a level of the background noise signal. The electronic ambient signal and the electronic internal signal can then be mixed in a ratio dependent on the background noise signal to produce a mixed signal without echo that is delivered to the ear canal by way of the ECR.

An internal gain of the electronic internal signal can be increased as background noise levels increase, while an external gain of the electronic ambient signal can be decreased as the background noise levels increase. Similarly, the internal gain of the electronic internal signal can be increased as background noise levels decrease, while an external gain of the electronic ambient signal can be increased as the background noise levels decrease. The step of mixing can include filtering the electronic ambient signal and the electronic internal signal based on a characteristic of the background noise signal. The characteristic can be a level of the background noise level, a spectral profile, or an envelope fluctuation.

At low background noise levels and low voice activity levels, the electronic ambient signal can be amplified relative to the electronic internal signal in producing the mixed signal. At medium background noise levels and voice activity levels, low frequencies in the electronic ambient signal and high frequencies in the electronic internal signal can be attenuated. At high background noise levels and high voice activity levels, the electronic internal signal can be amplified relative to the electronic ambient signal in producing the mixed signal.

The method can include adapting a first set of filter coefficients of a Least Mean Squares (LMS) filter to model an inner ear-canal microphone transfer function (ECTF). The voice activity level of the modified electronic internal signal can be monitored, and an adaptation of the first set of filter coefficients for the modified electronic internal signal can be frozen if the voice activity level is above a predetermined threshold. The voice activity level can be determined by an energy level characteristic and a frequency response characteristic. A second set of filter coefficients for a replica of the LMS filter can be generated during the freezing, and substituted back for the first set of filter coefficients when the voice activity level is below another predetermined threshold. The modified electronic internal signal can be transmitted to another voice communication device, and looped back to the ear canal.

In a second embodiment, a method for in-ear canal echo suppression control can include capturing an ambient sound from at least one Ambient Sound Microphone (ASM) to produce an electronic ambient signal, delivering audio content to an ear canal by way of an Ear Canal Receiver (ECR) to produce an acoustic audio content, capturing in the ear canal by way of an Ear Canal Receiver (ECR) the acoustic audio content to produce an electronic internal signal, generating a voice activity level of a spoken voice in the presence of the acoustic audio content, suppressing an echo of the spoken voice in the electronic internal signal to produce a modified electronic internal signal, and controlling a mixing of the electronic ambient signal and the electronic internal signal based on the voice activity level. At least one voice operation of the earpiece can be controlled based on the voice activity level. The modified electronic internal signal can be transmitted to another voice communication device and looped back to the ear canal.

The method can include measuring a background noise signal from the electronic ambient signal and the electronic internal signal, and mixing the electronic ambient signal with the electronic internal signal in a ratio dependent on the background noise signal to produce a mixed signal that is delivered to the ear canal by way of the ECR. An acoustic attenuation level of the earpiece and an audio content level reproduced can be accounted for when adjusting the mixing based on a level of the audio content, the background noise level, and an acoustic attenuation level of the earpiece. The electronic ambient signal and the electronic internal signal can be filtered based on a characteristic of the background noise signal. The characteristic can be a level of the background noise level, a spectral profile, or an envelope fluctuation. The method can include applying a first gain (G1) to the electronic ambient signal, and applying a second gain (G2) to the electronic internal signal. The first gain and second gain can be a function of the background noise level and the voice activity level.

The method can include adapting a first set of filter coefficients of a Least Mean Squares (LMS) filter to model an inner ear-canal microphone transfer function (ECTF). The adaptation of the first set of filter coefficients can be frozen for the modified electronic internal signal if the voice activity level is above a predetermined threshold. A second set of filter coefficients for a replica of the LMS filter can be adapted during the freezing. The second set can be substituted back for the first set of filter coefficients when the voice activity level is below another predetermined threshold. The adaptation of the first set of filter coefficients can then be unfrozen.

In a third embodiment, an earpiece to provide in-ear canal echo suppression can include an Ambient Sound Microphone (ASM) configured to capture ambient sound and produce an electronic ambient signal, an Ear Canal Receiver (ECR) to deliver audio content to an ear canal to produce an acoustic audio content, an Ear Canal Microphone (ECM) configured to capture internal sound including spoken voice in an ear canal and produce an electronic internal signal, and a processor operatively coupled to the ASM, the ECM and the ECR. The audio content can be a phone call, a voice message, a music signal, or the spoken voice. The processor can be configured to suppress an echo of the spoken voice in the electronic internal signal to produce a modified electronic internal signal, generate a voice activity level for the spoken voice based on characteristics of the modified electronic internal signal and a level of the background noise signal, and mix the electronic ambient signal with the electronic internal signal in a ratio dependent on the background noise signal to produce a mixed signal that is delivered to the ear canal by way of the ECR. The processor can play the mixed signal back to the ECR for loopback listening. A transceiver operatively coupled to the processor can transmit the mixed signal to a second communication device.

A Least Mean Squares (LMS) echo suppressor can model an inner ear-canal microphone transfer function (ECTF) between the ASM and the ECM. A voice activity detector operatively coupled to the echo suppressor can adapt a first set of filter coefficients of the echo suppressor to model an inner ear-canal microphone transfer function (ECTF), and freeze an adaptation of the first set of filter coefficients for the modified electronic internal signal if the voice activity level is above a predetermined threshold. The voice activity detector during the freezing can also adapt a second set of filter coefficients for the echo suppressor, and substitute the second set of filter coefficients for the first set of filter coefficients when the voice activity level is below another predetermined threshold. Upon completing the substitution, the processor can unfreeze the adaptation of the first set of filter coefficients

DETAILED DESCRIPTION

Figure 1:
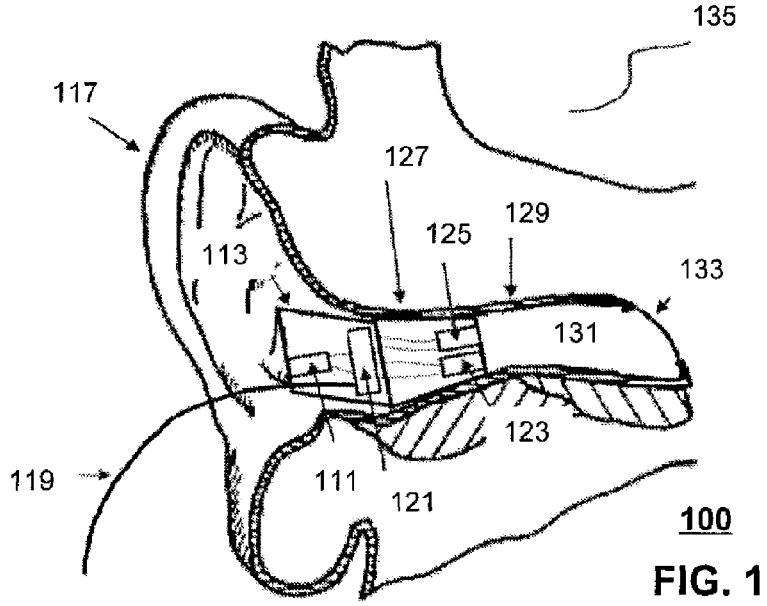
FIG. 1 is a pictorial diagram of an earpiece in accordance with an exemplary embodiment.

The following description of at least one exemplary embodiment is merely illustrative in nature and is in no way intended to limit the invention, its application, or uses.

Processes, techniques, apparatus, and materials as known by one of ordinary skill in the relevant art may not be discussed in detail but are intended to be part of the enabling description where appropriate, for example the fabrication and use of transducers.

In all of the examples illustrated and discussed herein, any specific values, for example the sound pressure level change, should be interpreted to be illustrative only and non-limiting. Thus, other examples of the exemplary embodiments could have different values.

Note that similar reference numerals and letters refer to similar items in the following figures, and thus once an item is defined in one figure, it may not be discussed for following figures.

Note that herein when referring to correcting or preventing an error or damage (e.g., hearing damage), a reduction of the damage or error and/or a correction of the damage or error are intended.

Various embodiments herein provide a method and device for automatically mixing audio signals produced by a pair of microphone signals that monitor a first ambient sound field and a second ear canal sound field, to create a third new mixed signal. An Ambient Sound Microphone (ASM) and an Ear Canal Microphone (ECM) can be housed in an earpiece that forms a seal in the ear of a user. The third mixed signal can be auditioned by the user with an Ear Canal Receiver (ECR) mounted in the earpiece, which creates a sound pressure in the occluded ear canal of the user. A voice activity detector can determine when the user is speaking and control an echo suppressor to suppress associated feedback in the ECR.

When the user engages in a voice communication, the echo suppressor can suppress feedback of the spoken voice from the ECR. The echo suppressor can contain two sets of filter coefficients; a first set that adapts when voice is not present and becomes fixed when voice is present, and a second set that adapts when the first set is fixed. The voice activity detector can discriminate between audible content, such as music, that the user is listening to, and spoken voice generated by the user when engaged in voice communication. The third mixed signal contains primarily the spoken voice captured at the ASM and ECM without echo, and can be transmitted to a remote voice communications system, such as a mobile phone, personal media player, recording device, walkie-talkie radio, etc. Before the ASM and ECM signals are mixed, they can be echo suppressed and subjected to different filters and at optional additional gains. This permits a single earpiece to provide full-duplex voice communication with proper or improper acoustic sealing.

The characteristic responses of the ASM and ECM filter can differ based on characteristics of the background noise and the voice activity level. In some exemplary embodiments, the filter response can depend on the measured Background Noise Level (BNL). A gain of a filtered ASM and a filtered ECM signal can also depend on the BNL. The (BNL) can be calculated using either or both the conditioned ASM and/or ECM signal(s). The BNL can be a slow time weighted average of the level of the ASM and/or ECM signals, and can be weighted using a frequency-weighting system, e.g. to give an A-weighted SPL level (i.e. the high and low frequencies are attenuated before the level of the microphone signals are calculated).

At least one exemplary embodiment of the invention is directed to an earpiece for voice operated control. Reference is made to FIG. 1 in which an earpiece device, generally indicated as earpiece 100, is constructed and operates in accordance with at least one exemplary embodiment of the invention. As illustrated, earpiece 100 depicts an electro-acoustical assembly 113 for an in-the-ear acoustic assembly, as it would typically be placed in the ear canal 131 of a user 135. The earpiece 100 can be an in the ear earpiece, behind the ear earpiece, receiver in the ear, open-fit device, or any other suitable earpiece type. The earpiece 100 can be partially or fully occluded in the ear canal, and is suitable for use with users having healthy or abnormal auditory functioning.

Earpiece 100 includes an Ambient Sound Microphone (ASM) 111 to capture ambient sound, an Ear Canal Receiver (ECR) 125 to deliver audio to an ear canal 131, and an Ear Canal Microphone (ECM) 123 to assess a sound exposure level within the ear canal 131. The earpiece 100 can partially or fully occlude the ear canal 131 to provide various degrees of acoustic isolation. The assembly is designed to be inserted into the user's ear canal 131, and to form an acoustic seal with the walls 129 of the ear canal at a location 127 between the entrance 117 to the ear canal and the tympanic membrane (or ear drum) 133. Such a seal is typically achieved by means of a soft and compliant housing of assembly 113. Such a seal creates a closed cavity 131 of approximately 5 cc between the in-ear assembly 113 and the tympanic membrane 133. As a result of this seal, the ECR (speaker) 125 is able to generate a full range frequency response when reproducing sounds for the user. This seal also serves to significantly reduce the sound pressure level at the user's eardrum resulting from the sound field at the entrance to the ear canal 131. This seal is also a basis for a sound isolating performance of the electro-acoustic assembly.

Located adjacent to the ECR 125, is the ECM 123, which is acoustically coupled to the (closed or partially closed) ear canal cavity 131. One of its functions is that of measuring the sound pressure level in the ear canal cavity 131 as a part of testing the hearing acuity of the user as well as confirming the integrity of the acoustic seal and the working condition of the earpiece 100. In one arrangement, the ASM 111 can be housed in the assembly 113 to monitor sound pressure at the entrance to the occluded or partially occluded ear canal. All transducers shown can receive or transmit audio signals to a processor 121 that undertakes audio signal processing and provides a transceiver for audio via the wired or wireless communication path 119.

The earpiece 100 can actively monitor a sound pressure level both inside and outside an ear canal and enhance spatial and timbral sound quality while maintaining supervision to ensure safe sound reproduction levels. The earpiece 100 in various embodiments can conduct listening tests, filter sounds in the environment, monitor warning sounds in the environment, present notification based on identified warning sounds, maintain constant audio content to ambient sound levels, and filter sound in accordance with a Personalized Hearing Level (PHL).

The earpiece 100 can measure ambient sounds in the environment received at the ASM 111. Ambient sounds correspond to sounds within the environment such as the sound of traffic noise, street noise, conversation babble, or any other acoustic sound. Ambient sounds can also correspond to industrial sounds present in an industrial setting, such as, factory noise, lifting vehicles, automobiles, and robots to name a few.

The earpiece 100 can generate an Ear Canal Transfer Function (ECTF) to model the ear canal 131 using ECR 125 and ECM 123, as well as an Outer Ear Canal Transfer function (OETF) using ASM 111. For instance, the ECR 125 can deliver an impulse within the ear canal and generate the ECTF via cross correlation of the impulse with the impulse response of the ear canal. The earpiece 100 can also determine a sealing profile with the user's ear to compensate for any leakage. It also includes a Sound Pressure Level Dosimeter to estimate sound exposure and recovery times. This permits the earpiece 100 to safely administer and monitor sound exposure to the ear.

Figure 2:
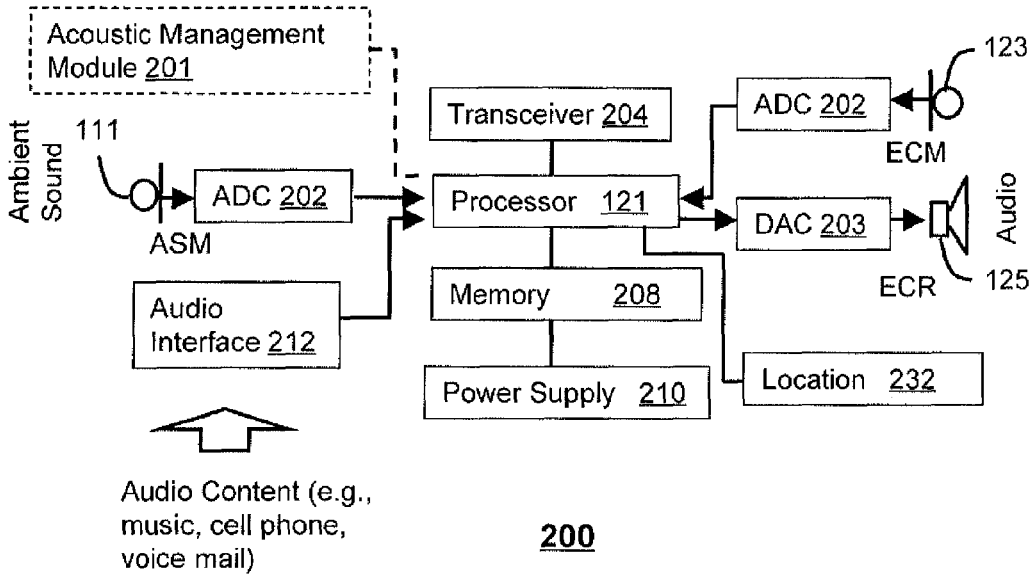
FIG. 2 is a block diagram of the earpiece in accordance with an exemplary embodiment.

Referring to FIG. 2, a block diagram 200 of the earpiece 100 in accordance with an exemplary embodiment is shown. As illustrated, the earpiece 100 can include the processor 121 operatively coupled to the ASM 111, ECR 125, and ECM 123 via one or more Analog to Digital Converters (ADC) 202 and Digital to Analog Converters (DAC) 203. The processor 121 can utilize computing technologies such as a microprocessor, Application Specific Integrated Chip (ASIC), and/or digital signal processor (DSP) with associated storage memory 208 such as Flash, ROM, RAM, SRAM, DRAM or other like technologies for controlling operations of the earpiece device 100. The processor 121 can also include a clock to record a time stamp.

As illustrated, the earpiece 100 can include an acoustic management module 201 to mix sounds captured at the ASM 111 and ECM 123 to produce a mixed sound. The processor 121 can then provide the mixed signal to one or more subsystems, such as a voice recognition system, a voice dictation system, a voice recorder, or any other voice related processor or communication device. The acoustic management module 201 can be a hardware component implemented by discrete or analog electronic components or a software component. In one arrangement, the functionality of the acoustic management module 201 can be provided by way of software, such as program code, assembly language, or machine language.

The memory 208 can also store program instructions for execution on the processor 121 as well as captured audio processing data and filter coefficient data. The memory 208 can be off-chip and external to the processor 121, and include a data buffer to temporarily capture the ambient sound and the internal sound, and a storage memory to save from the data buffer the recent portion of the history in a compressed format responsive to a directive by the processor 121. The data buffer can be a circular buffer that temporarily stores audio sound at a current time point to a previous time point. It should also be noted that the data buffer can in one configuration reside on the processor 121 to provide high speed data access. The storage memory can be non-volatile memory such as SRAM to store captured or compressed audio data.

The earpiece 100 can include an audio interface 212 operatively coupled to the processor 121 and acoustic management module 201 to receive audio content, for example from a media player, cell phone, or any other communication device, and deliver the audio content to the processor 121. The processor 121 responsive to detecting spoken voice from the acoustic management module 201 can adjust the audio content delivered to the ear canal. For instance, the processor 121 (or acoustic management module 201) can lower a volume of the audio content responsive to detecting a spoken voice. The processor 121 by way of the ECM 123 can also actively monitor the sound exposure level inside the ear canal and adjust the audio to within a safe and subjectively optimized listening level range based on voice operating decisions made by the acoustic management module 201.

The earpiece 100 can further include a transceiver 204 that can support singly or in combination any number of wireless access technologies including without limitation Bluetooth™, Wireless Fidelity (WiFi), Worldwide Interoperability for Microwave Access (WiMAX), and/or other short or long range communication protocols. The transceiver 204 can also provide support for dynamic downloading over-the-air to the earpiece 100. It should be noted also that next generation access technologies can also be applied to the present disclosure.

The location receiver 232 can utilize common technology such as a common GPS (Global Positioning System) receiver that can intercept satellite signals and therefrom determine a location fix of the earpiece 100.

The power supply 210 can utilize common power management technologies such as replaceable batteries, supply regulation technologies, and charging system technologies for supplying energy to the components of the earpiece 100 and to facilitate portable applications. A motor (not shown) can be a single supply motor driver coupled to the power supply 210 to improve sensory input via haptic vibration. As an example, the processor 121 can direct the motor to vibrate responsive to an action, such as a detection of a warning sound or an incoming voice call.

The earpiece 100 can further represent a single operational device or a family of devices configured in a master-slave arrangement, for example, a mobile device and an earpiece. In the latter embodiment, the components of the earpiece 100 can be reused in different form factors for the master and slave devices.

Figure 3:
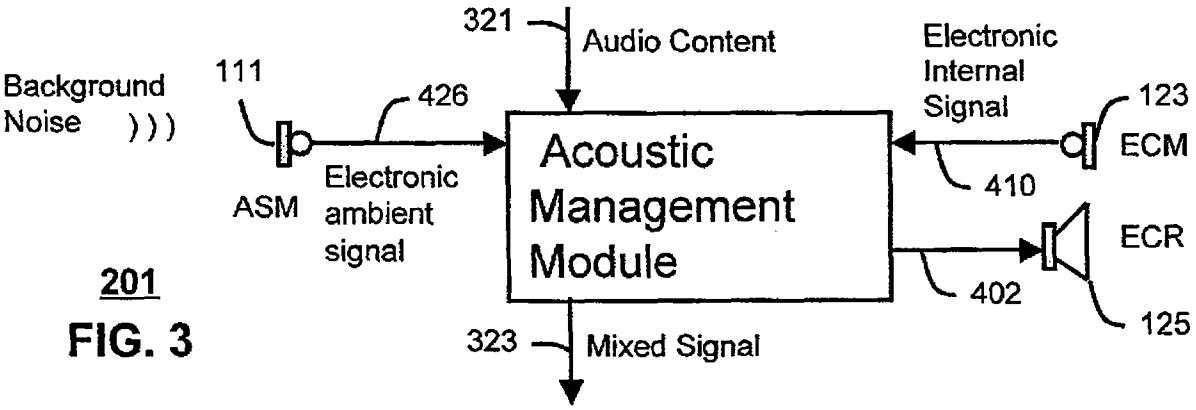
FIG. 3 is a block diagram for an acoustic management module in accordance with an exemplary embodiment.

FIG. 3 is a block diagram of the acoustic management module 201 in accordance with an exemplary embodiment. Briefly, the Acoustic management module 201 facilitates monitoring, recording and transmission of user-generated voice (speech) to a voice communication system. User-generated sound is detected with the ASM 111 that monitors a sound field near the entrance to a user's ear, and with the ECM 123 that monitors a sound field in the user's occluded ear canal. A new mixed signal 323 is created by filtering and mixing the ASM and ECM microphone signals. The filtering and mixing process is automatically controlled depending on the background noise level of the ambient sound field to enhance intelligibility of the new mixed signal 323. For instance, when the background noise level is high, the acoustic management module 201 automatically increases the level of the ECM 123 signal relative to the level of the ASM 111 to create the new signal mixed 323. When the background noise level is low, the acoustic management module 201 automatically decreases the level of the ECM 123 signal relative to the level of the ASM 111 to create the new signal mixed 323

As illustrated, the ASM 111 is configured to capture ambient sound and produce an electronic ambient signal 426, the ECR 125 is configured to pass, process, or play acoustic audio content 402 (e.g., audio content 321, mixed signal 323) to the ear canal, and the ECM 123 is configured to capture internal sound in the ear canal and produce an electronic internal signal 410. The acoustic management module 201 is configured to measure a background noise signal from the electronic ambient signal 426 or the electronic internal signal 410, and mix the electronic ambient signal 426 with the electronic internal signal 410 in a ratio dependent on the background noise signal to produce the mixed signal 323. The acoustic management module 201 filters the electronic ambient signal 426 and the electronic internal 410 signal based on a characteristic of the background noise signal using filter coefficients stored in memory or filter coefficients generated algorithmically.

In practice, the acoustic management module 201 mixes sounds captured at the ASM 111 and the ECM 123 to produce the mixed signal 323 based on characteristics of the background noise in the environment and a voice activity level. The characteristics can be a background noise level, a spectral profile, or an envelope fluctuation. The acoustic management module 201 manages echo feedback conditions affecting the voice activity level when the ASM 111, the ECM 123, and the ECR 125 are used together in a single earpiece for full-duplex communication, when the user is speaking to generate spoken voice (captured by the ASM 111 and ECM 123) and simultaneously listening to audio content (delivered by ECR 125).

In noisy ambient environments, the voice captured at the ASM 111 includes the background noise from the environment, whereas, the internal voice created in the ear canal 131 captured by the ECM 123 has less noise artifacts, since the noise is blocked due to the occlusion of the earpiece 100 in the ear. It should be noted that the background noise can enter the ear canal if the earpiece 100 is not completely sealed. In this case, when speaking, the user's voice can leak through and cause an echo feedback condition that the acoustic management module 201 mitigates.

Figure 4:
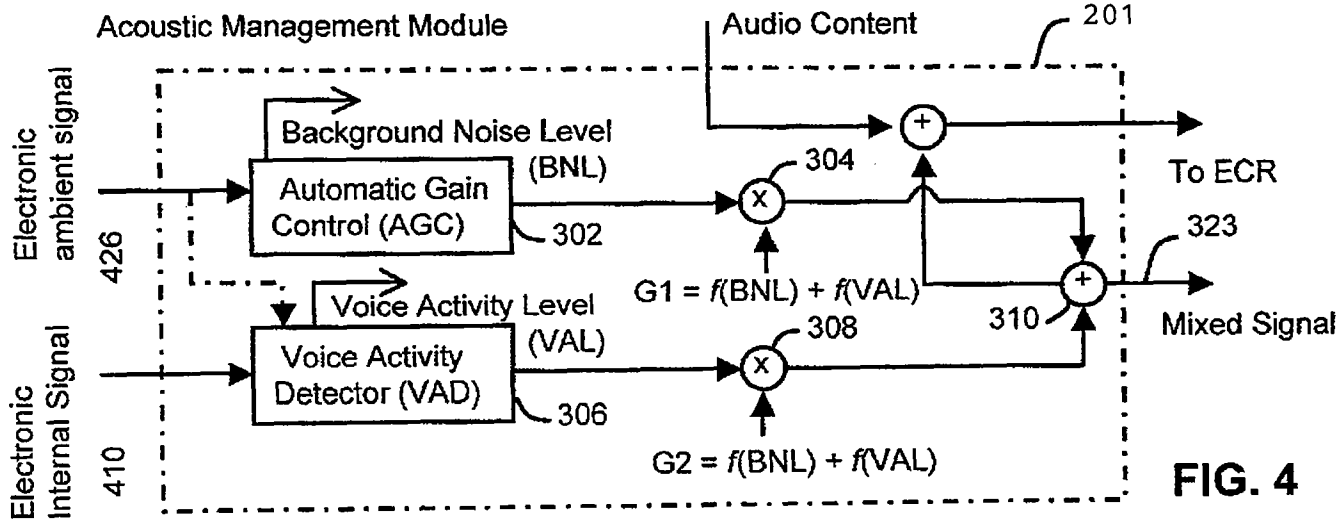
FIG. 4 is a schematic for the acoustic management module of FIG. 3 illustrating a mixing of an external microphone signal with an internal microphone signal as a function of a background noise level and voice activity level in accordance with an exemplary embodiment.

FIG. 4 is a schematic of the acoustic management module 201 illustrating a mixing of the electronic ambient signal 426 with the electronic internal signal 410 as a function of a background noise level (BNL) and a voice activity level (VAL) in accordance with an exemplary embodiment. As illustrated, the acoustic management module 201 includes an Automatic Gain Control (AGC) 302 to measure background noise characteristics. The acoustic management module 201 also includes a Voice Activity Detector (VAD) 306. The VAD 306 can analyze either or both the electronic ambient signal 426 and the electronic internal signal 410 to estimate the VAL. As an example, the VAL can be a numeric range such as 0 to 10 indicating a degree of voicing. For instance, a voiced signal can be predominately periodic due to the periodic vibrations of the vocal cords. A highly voiced signal (e.g., vowel) can be associated with a high level, and a non-voiced signal (e.g., fricative, plosive, consonant) can be associated with a lower level.

The acoustic management module 201 includes a first gain (G1) 304 applied to the AGC processed electronic ambient signal 426. A second gain (G2) 308 is applied to the VAD processed electronic internal signal 410. The acoustic management module 201 applies the first gain (G1) 304 and the second gain (G2) 308 as a function of the background noise level and the voice activity level to produce the mixed signal 323, where $$G1=f(\text{BNL})+f(\text{VAL})\text{and } G2=f(\text{BNL})+f(\text{VAL})$$

As illustrated, the mixed signal 323 is the sum 310 of the G1 scaled electronic ambient signal and the G2 scaled electronic internal signal. The mixed signal 323 can then be transmitted to a second communication device (e.g. second cell phone, voice recorder, etc.) to receive the enhanced voice signal. The acoustic management module 201 can also play the mixed signal 323 back to the ECR for loopback listening. The loopback allows the user to hear himself or herself when speaking, as though the earpiece 100 and associated occlusion effect were absent. The loopback can also be mixed with the audio content 321 based on the background noise level, the VAL, and audio content level. The acoustic management module 201 can also account for an acoustic attenuation level of the earpiece, and account for the audio content level reproduced by the ECR when measuring background noise characteristics. Echo conditions created as a result of the loopback can be mitigated to ensure that the voice activity level is accurate.

Figure 5:
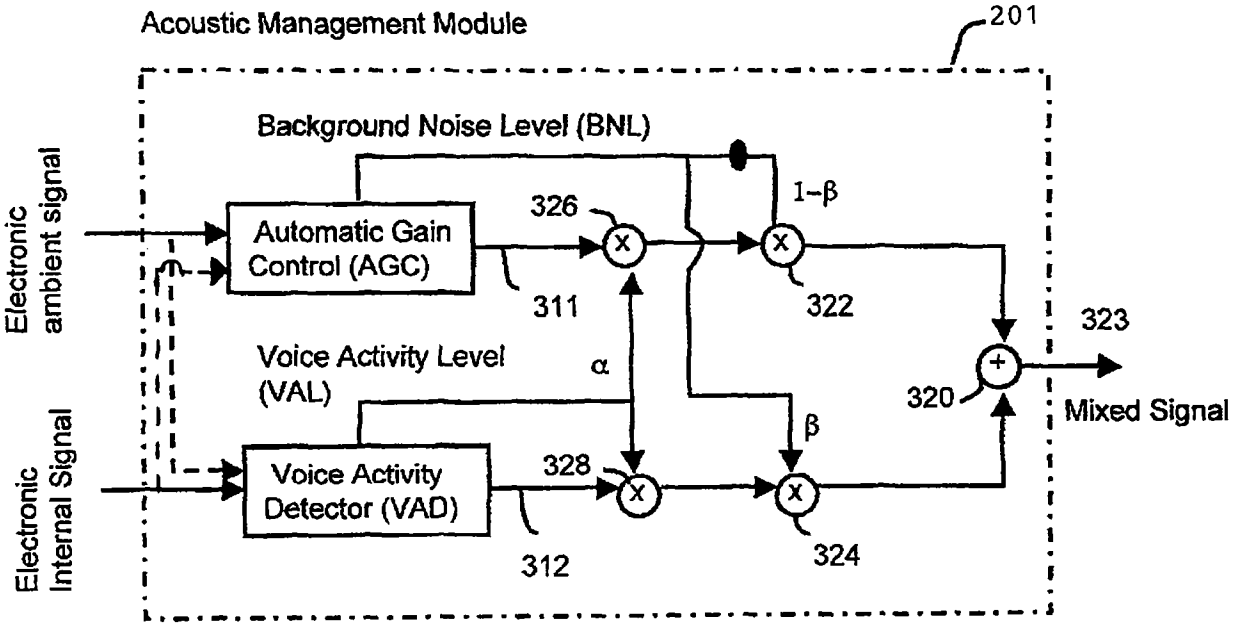
FIG. 5 is a more detailed schematic of the acoustic management module of FIG. 3 illustrating a mixing of an external microphone signal with an internal microphone signal based on a background noise level and voice activity level in accordance with an exemplary embodiment.

FIG. 5 is a more detailed schematic of the acoustic management module 201 illustrating a mixing of an external microphone signal with an internal microphone signal based on a background noise level and voice activity level in accordance with an exemplary embodiment. In particular, the gain blocks for G1 and G2 of FIG. 4 are a function of the BNL and the VAL and are shown in greater detail. As illustrated, the AGC produces a BNL that can be used to set a first gain 322 for the processed electronic ambient signal 311 and a second gain 324 for the processed electronic internal signal 312. For instance, when the BNL is low (<70 dBA), gain 322 is set higher relative to gain 324 so as to amplify the electronic ambient signal 311 in greater proportion than the electronic internal signal 312. When the BNL is high (>85 dBA), gain 322 is set lower relative to gain 324 so as to attenuate the electronic ambient signal 311 in greater proportion than the electronic internal signal 312. The mixing can be performed in accordance with the relation:

Mixed signal=(1−β)*electronic ambient signal+(β)*electronic internal signal where (1−β) is an external gain, (β) is an internal gain, and the mixing is performed with $0<\beta<1$.

As illustrated, the VAD produces a VAL that can be used to set a third gain 326 for the processed electronic ambient signal 311 and a fourth gain 328 for the processed electronic internal signal 312. For instance, when the VAL is low (e.g., 0-3), gain 326 and gain 328 are set low so as to attenuate the electronic ambient signal 311 and the electronic internal signal 312 when spoken voice is not detected. When the VAL is high (e.g., 7-10), gain 326 and gain 328 are set high so as to amplify the electronic ambient signal 311 and the electronic internal signal 312 when spoken voice is detected.

The gain scaled processed electronic ambient signal 311 and the gain scaled processed electronic internal signal 312 are then summed at adder 320 to produce the mixed signal 323. The mixed signal 323, as indicated previously, can be transmitted to another communication device, or as loopback to allow the user to hear his or her self.

Figure 6:
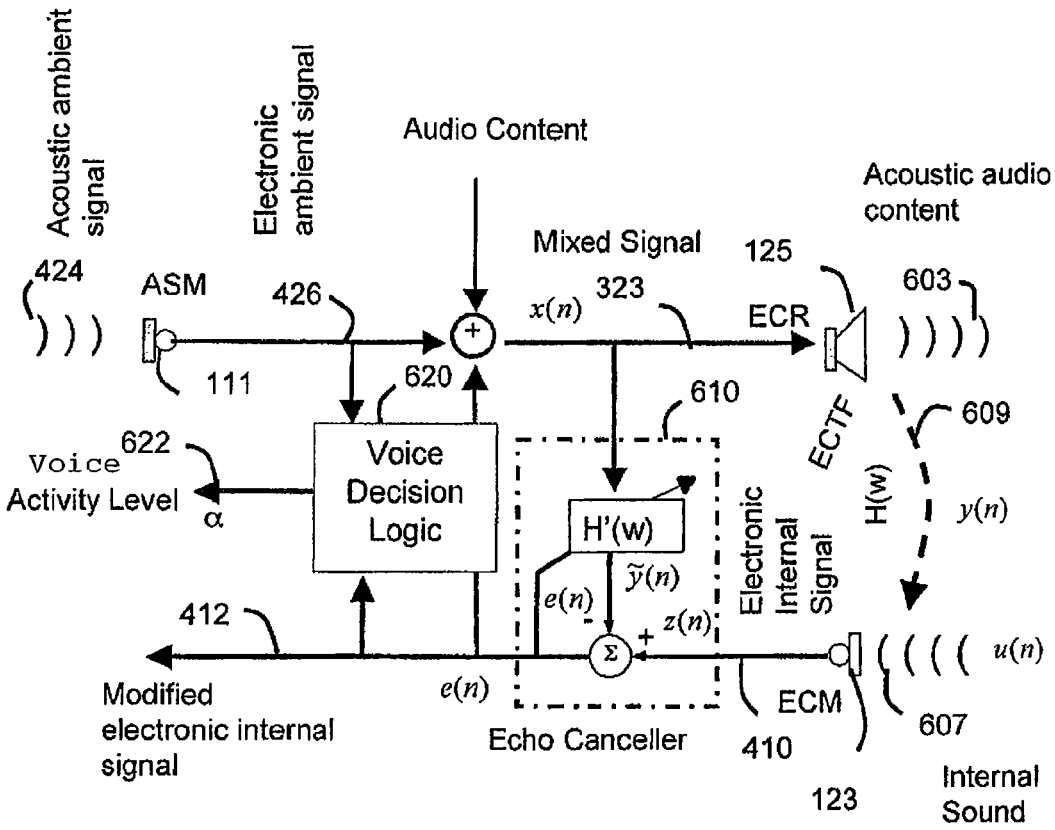
FIG. 6 is a block diagram of a system for in-ear canal echo suppression in accordance with an exemplary embodiment.

FIG. 6 is an exemplary schematic of an operational unit 600 of the acoustic management module for in-ear canal echo suppression in accordance with an embodiment. The operational unit 600 may contain more or less than the number of components shown in the schematic. The operational unit 600 can include an echo suppressor 610 and a voice decision logic 620.

The echo suppressor 610 can be a Least Mean Squares (LMS) or Normalized Least Mean Squares (NLMS) adaptive filter that models an ear canal transfer function (ECTF) between the ECR 125 and the ECM 123. The echo suppressor 610 generates the modified electronic signal, e(n), which is provided as an input to the voice decision logic 620; e(n) is also termed the error signal e(n) of the echo suppressor 610. Briefly, the error signal e(n) 412 is used to update the filter H(w) to model the ECTF of the echo path. The error signal e(n) 412 closely approximates the user's spoken voice signal u(n) 607 when the echo suppressor 610 accurately models the ECTF.

In the configuration shown the echo suppressor 610 minimizes the error between the filtered signal, $\tilde{\gamma}(n)$, and the electronic internal signal, z(n), in an effort to obtain a transfer function H' which is a best approximation to the H(w) (i.e., ECTF). H(w) represents the transfer function of the ear canal and models the echo response. (z(n)=u(n)+y(n)+v(n), where u(n) is the spoken voice 607, y(n) is the echo 609, and v(n) is background noise (if present, for instance due to improper sealing).)

During operation, the echo suppressor 610 monitors the mixed signal 323 delivered to the ECR 125 and produces an echo estimate $\tilde{y}(n)$ of an echo y(n) 609 based on the captured electronic internal signal 410 and the mixed signal 323. The echo suppressor 610, upon learning the ECTF by an adaptive process, can then suppress the echo y(n) 609 of the acoustic audio content 603 (e.g., output mixed signal 323) in the electronic internal signal z(n) 410. It subtracts the echo estimate $\tilde{\gamma}(n)$ from the electronic internal signal 410 to produce the modified electronic internal signal e(n) 412.

The voice decision logic 620 analyzes the modified electronic signal 412 e(n) and the electronic ambient signal 426 to produce a voice activity level 622, α. The voice activity level a identifies a probability that the user is speaking, for example, when the user is using the earpiece for two way voice communication. The voice activity level 622 can also indicate a degree of voicing (e.g., periodicity, amplitude), When the user is speaking, voice is captured externally (such as from acoustic ambient signal 424) by the ASM 111 in the ambient environment and also by the ECM 123 in the ear canal. The voice decision logic provides the voice activity level α to the acoustic management module 201 as an input parameter for mixing the ASM 111 and ECM 123 signals. Briefly referring back to FIG. 4, the acoustic management module 201 performs the mixing as a function of the voice activity level α and the background noise level (see G=f(BNL)+f(VAL)).

For instance, at low background noise levels and low voice activity levels, the acoustic management module 201 amplifies the electronic ambient signal 426 from the ASM 111 relative to the electronic internal signal 410 from the ECM 123 in producing the mixed signal 323. At medium background noise levels and medium voice activity levels, the acoustic management module 201 attenuates low frequencies in the electronic ambient signal 426 and attenuates high frequencies in the electronic internal signal 410. At high background noise levels and high voice activity levels, the acoustic management module 201 amplifies the electronic internal signal 410 from the ECM 123 relative to the electronic ambient signal 426 from the ASM 111 in producing the mixed signal. The acoustic management module 201 can additionally apply frequency specific filters based on the characteristics of the background noise.

Figure 7:
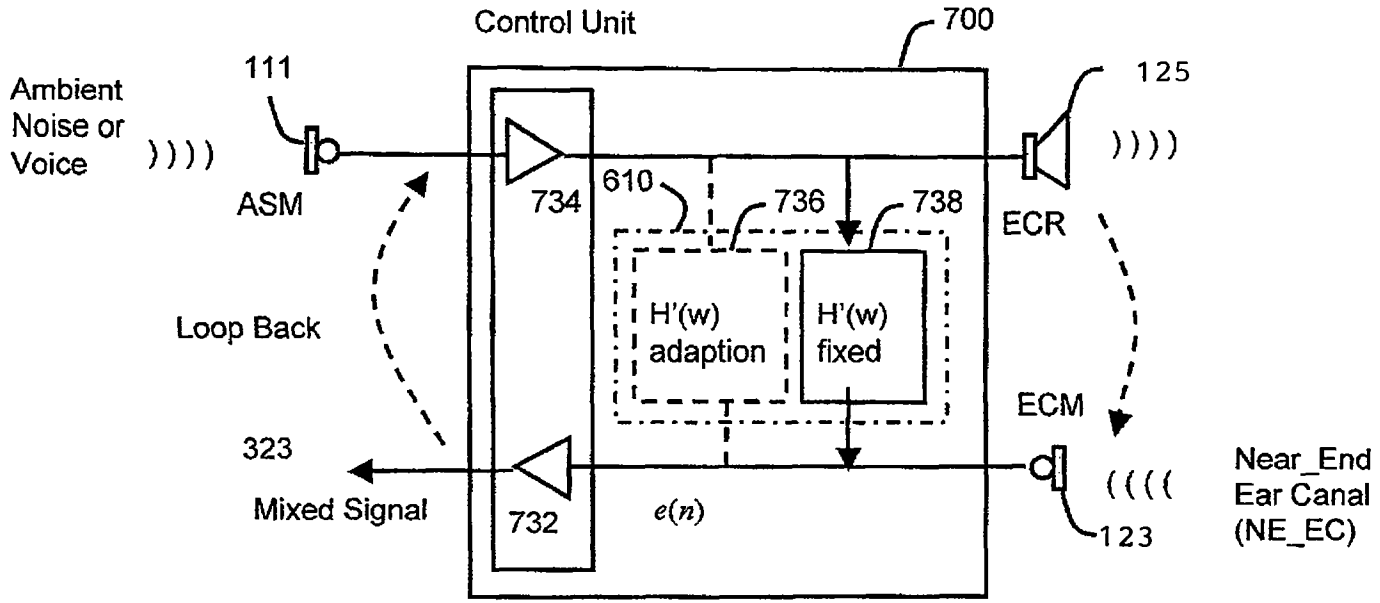
FIG. 7 is a schematic of a control unit for controlling adaptation of a first set and second set of filter coefficients of an echo suppressor for in-ear canal echo suppression in accordance with an exemplary embodiment.

FIG. 7 is a schematic of a control unit 700 for controlling adaptation of a first set (736) and a second set (738) of filter coefficients of the echo suppressor 610 for in-ear canal echo suppression in accordance with an exemplary embodiment. Briefly, the control unit 700 illustrates a freezing (fixing) of weights upon detection of spoken voice. The echo suppressor resumes weight adaptation when e(n) is low, and freezes weights when e(n) is high signifying a presence of spoken voice.

When the user is not speaking, the ECR 125 can pass through ambient sound captured at the ASM 111, thereby allowing the user to hear environmental ambient sounds. As previously discussed, the echo suppressor 610 models an ECTF and suppresses an echo of the mixed signal 323 that is looped back to the ECR 125 by way of the ASM 111 (see dotted line Loop Back path). When the user is not speaking, the echo suppressor continually adapts to model the ECTF. When the ECTF is properly modeled, the echo suppressor 610 produces a modified internal electronic signal e(n) that is low in amplitude level (i.e., low in error). The echo suppressor adapts the weights to keep the error signal low. When the user speaks, the echo suppressor however initially produces a high-level e(n) (e.g., the error signal increases). This happens since the speaker's voice is uncorrelated with the audio signal played out the ECR 125, which disrupts the echo suppressor's ECTF modeling ability.

The control unit 700 upon detecting a rise in e(n), freezes the weights of the echo suppressor 610 to produce a fixed filter H'(w) fixed 738. Upon detecting the rise in e(n) the control unit adjusts the gain 734 for the ASM signal and the gain 732 for the mixed signal 323 that is looped back to the ECR 125. The mixed signal 323 fed back to the ECR 125 permits the user to hear themselves speak. Although the weights are frozen when the user is speaking, a second filter H'(w) 736 continually adapts the weights for generating a second e(n) that is used to determine a presence of spoken voice. That is, the control unit 700 monitors the second error signal e(n) produced by the second filter 736 for monitoring a presence of the spoken voice.

The first error signal e(n) (in a parallel path) generated by the first filter 738 is used as the mixed signal 323. The first error signal contains primarily the spoken voice since the ECTF model has been fixed due to the weights. That is, the second (adaptive) filter is used to monitor a presence of spoken voice, and the first (fixed) filter is used to generate the mixed signal 323.

Upon detecting a fall of e(n), the control unit restores the gains 734 and 732 and unfreezes the weights of the echo suppressor, and the first filter H'(w) returns to being an adaptive filter. The second filter H'(w) 736 remains on stand-by until spoken voice is detected, and at which point, the first filter H'(w) 738 goes fixed, and the second filter H'(w) 736 begins adaptation for producing the e(n) signal that is monitored for voice activity. Notably, the control unit 700 monitors e(n) from the first filter 738 or the second filter 736 for changes in amplitude to determine when spoken voice is detected based on the state of voice activity.

Where applicable, the present embodiments of the invention can be realized in hardware, software or a combination of hardware and software. Any kind of computer system or other apparatus adapted for carrying out the methods described herein are suitable. A typical combination of hardware and software can be a mobile communications device with a computer program that, when being loaded and executed, can control the mobile communications device such that it carries out the methods described herein. Portions of the present method and system may also be embedded in a computer program product, which comprises all the features enabling the implementation of the methods described herein and which when loaded in a computer system, is able to carry out these methods.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions of the relevant exemplary embodiments. Thus, the description of the invention is merely exemplary in nature and, thus, variations that do not depart from the gist of the invention are intended to be within the scope of the exemplary embodiments of the present invention. Such variations are not to be regarded as a departure from the spirit and scope of the present invention.

What is claimed is:

1. A method for in-ear canal echo suppression control suitable for use in an earpiece, the method comprising the steps of:

capturing an ambient acoustic signal from at least one Ambient Sound Microphone (ASM) to produce an electronic ambient signal;

capturing in an ear canal an internal sound from at least one Ear Canal Microphone (ECM) to produce an electronic internal signal, the electronic internal signal including an echo of a spoken voice generated by a wearer of the earpiece;

measuring a background noise signal from the electronic ambient signal and the electronic internal signal;

suppressing the echo in the electronic internal signal to produce a modified electronic internal signal containing primarily the spoken voice;

generating a voice activity level for the spoken voice based on characteristics of the modified electronic internal signal and a level of the background noise signal; and mixing and adjusting the electronic ambient signal with the electronic internal signal in a ratio dependent on at least one of the voice activity level or the background noise signal to produce a mixed signal that is delivered to the ear canal by way of an Ear Canal Receiver (ECR).

2. The method of claim 1, comprising increasing an internal gain of the electronic internal signal as background noise levels increase, while decreasing an external gain of the electronic ambient signal as the background noise levels increase, or decreasing the internal gain of the electronic internal signal as the background noise levels decrease, while increasing the external gain of the electronic ambient signal as the background noise levels decrease.

3. The method of claim 1, where the step of mixing includes filtering the electronic ambient signal and the electronic internal signal based on a characteristic of the background noise signal, where the characteristic is the level of the background noise signal, a spectral profile, or an envelope fluctuation.

4. The method of claim 3, further comprising adapting a first set of filter coefficients of a Least Mean Squares (LMS) filter to model an ear canal microphone transfer function (ECTF).

5. The method of claim 4, further comprising monitoring the voice activity level of the modified electronic internal signal; and freezing an adaptation of the first set of filter coefficients for the modified electronic internal signal if the voice activity level is above a predetermined threshold.

6. The method of claim 5, further comprising transmitting the modified electronic internal signal to a voice communication device.

7. The method of claim 5, further comprising looping back the modified electronic internal signal to the ear canal.

8. The method of claim 4, wherein the voice activity level is determined by an energy level characteristic and a frequency response characteristic.

9. The method of claim 4, further comprising adapting a second set of filter coefficients for a replica of the LMS filter, and substituting the second set of filter coefficients for the first set of filter coefficients when the voice activity level is below a predetermined threshold.

10. The method of claim 1, comprising at low background noise levels and low voice activity levels, amplifying the electronic ambient signal relative to the electronic internal signal in producing the mixed signal, at medium background noise levels and medium voice activity levels, attenuating low frequencies in the electronic ambient signal and attenuating high frequencies in the electronic internal signal, and at high background noise levels and high voice activity levels, amplifying the electronic internal signal relative to the electronic ambient signal in producing the mixed signal.

11. A method for in-ear canal echo suppression control suitable for use in an earpiece, the method comprising the steps of:

capturing an ambient sound from at least one Ambient Sound Microphone (ASM) to produce an electronic ambient signal;

delivering audio content to an ear canal by way of an Ear Canal Receiver (ECR) to produce an acoustic audio content;

capturing in the ear canal by way of an Ear Canal Microphone (ECM) the acoustic audio content to produce an electronic internal signal, the electronic internal signal including an echo of a spoken voice generated by a wearer of the earpiece;

suppressing the echo of the spoken voice in the electronic internal signal to produce a modified electronic internal signal;

generating a voice activity level of the spoken voice based on the modified electronic internal signal and the electronic ambient signal; and controlling a mixing and an adjusting of the electronic ambient signal and the electronic internal signal based on the voice activity level.

12. The method of claim 11, further comprising measuring a background noise signal from the electronic ambient signal and the electronic internal signal; and mixing the electronic ambient signal with the electronic internal signal in a ratio dependent on the background noise signal to produce a mixed signal that is delivered to the ear canal by way of the ECR.

13. The method of claim 12, further comprising accounting for an acoustic attenuation level of the earpiece;

accounting for an audio content level reproduced by the ECR that delivers the audio content to the earpiece; and adjusting the mixing based on the audio content level, a level of the background noise signal, and the acoustic attenuation level of the earpiece.

14. The method of claim 12, further comprising filtering the electronic ambient signal and the electronic internal signal based on a characteristic of the background noise signal, where the characteristic is a level of the background noise signal, a spectral profile, or an envelope fluctuation.

15. The method of claim 11, further comprising adapting a first set of filter coefficients of a Least Mean Squares (LMS) filter to model an ear canal microphone transfer function (ECTF);

freezing an adaptation of the first set of filter coefficients for the modified electronic internal signal if the voice activity level is above a first predetermined threshold, while adapting a second set of filter coefficients for a replica of the LMS filter; and substituting the second set of filter coefficients for the first set of filter coefficients when the voice activity level is below a second predetermined threshold and unfreezing the adaptation of the first set of filter coefficients.

16. The method of claim 11, wherein the mixing is performed by applying a first gain (G1) to the electronic ambient signal, and applying a second gain (G2) to the electronic internal signal, where the first gain and the second gain are a function of a background noise level (BNL) and the voice activity level (VAL), according to the relation:

$$G1=f(\mathrm{BNL})+f(\mathrm{VAL})\text{and } G2=f(\mathrm{BNL})+f(\mathrm{VAL}).$$

17. The method of claim 11, comprising controlling at least one voice operation of the earpiece based on the voice activity level.

18. The method of claim 11, comprising transmitting the modified electronic internal signal to another voice communication device; and looping back the modified electronic internal signal to the ear canal.

19. An earpiece to provide in-ear canal echo suppression, comprising:

an Ambient Sound Microphone (ASM) configured to capture ambient sound and produce an electronic ambient signal;

an Ear Canal Receiver (ECR) configured to deliver audio content to an ear canal;

an Ear Canal Microphone (ECM) configured to capture internal sound in the ear canal and produce an electronic internal signal, the electronic internal signal including an echo of a spoken voice generated by a wearer of the earpiece; and a processor operatively coupled to the ASM, the ECM and the ECR where the processor is configured to:

measure a background noise signal from the electronic ambient signal and the electronic internal signal;

suppress the echo of the spoken voice in the electronic internal signal to produce a modified electronic internal signal containing primarily the spoken voice;

generate a voice activity level for the spoken voice based on characteristics of the modified electronic internal signal and a level of the background noise signal; and mix and adjust the electronic ambient signal with the electronic internal signal in a ratio dependent on at least one of the voice activity level or the background noise signal to produce a mixed signal that is delivered to the ear canal by way of the ECR.

20. The earpiece of claim 19, further comprising a Least Mean Squares (LMS) echo suppressor to model an ear canal microphone transfer function (ECTF) between the ASM and the ECM.

21. The earpiece of claim 19, further comprising a transceiver operatively coupled to the processor to transmit the mixed signal to a further communication device.

22. The earpiece of claim 21, where the processor plays the mixed signal back to the ECR for loopback listening.

23. The earpiece of claim 20, comprising a voice activity detector operatively coupled to the echo suppressor to adapt a first set of filter coefficients of the echo suppressor to model an ear canal microphone transfer function (ECTF);

freeze an adaptation of the first set of filter coefficients for the modified electronic internal signal if the voice activity level is above a first predetermined threshold, while adapting a second set of filter coefficients for the echo suppressor; and substitute the second set of filter coefficients for the first set of filter coefficients when the voice activity level is below a second predetermined threshold and unfreezing the adaptation of the first set of filter coefficients.

24. The earpiece of claim 19, wherein the audio content is at least one among a phone call, a voice message, a music signal, and the spoken voice.

* * * * *